US008841567B1

(12) United States Patent
Fischer et al.

(10) Patent No.: US 8,841,567 B1
(45) Date of Patent: Sep. 23, 2014

(54) COMPACT AND MECHANICAL INERTIAL IGNITERS FOR THERMAL BATTERIES AND THE LIKE FOR MUNITIONS WITH SHORT DURATION FIRING SETBACK SHOCK

(71) Applicants: Jacques Fischer, Sound Beach, NY (US); Jahangir S Rastegar, Stony Brook, NY (US)

(72) Inventors: Jacques Fischer, Sound Beach, NY (US); Jahangir S Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 0 days.

(21) Appl. No.: 13/784,737

(22) Filed: Mar. 4, 2013

(51) Int. Cl.

| | |
|---|---|
| ***H01H 35/02*** | (2006.01) |
| ***H01H 43/08*** | (2006.01) |
| ***F42D 1/055*** | (2006.01) |
| ***H01M 6/36*** | (2006.01) |

(52) U.S. Cl.
USPC ..... 200/61.45 R; 200/46; 102/200; 429/115

(58) Field of Classification Search
None
See application file for complete search history.

(56) References Cited

U.S. PATENT DOCUMENTS

| | | | | |
|---|---|---|---|---|
| 6,341,562 | B1 * | 1/2002 | Brisighella | 102/202.14 |
| 6,568,331 | B2 * | 5/2003 | Hofmann et al. | 102/464 |
| 7,117,796 | B1 * | 10/2006 | Bogle et al. | 102/275.6 |

* cited by examiner

*Primary Examiner* — Cynthia K. Walls

(57) ABSTRACT

An inertial igniter including: a body having a base; a striker release element rotatably disposed on the body, the striker release element having a first surface; a first biasing element for biasing the striker release element away from the base; a striker mass rotatably disposed on the base along a second axis, the striker mass having a second surface corresponding to the first surface of the striker release element, the first surface obstructing rotation of the striker mass; and a second biasing element for biasing the striker mass such that the second surface is biased towards the first surface; wherein when the body experiences an acceleration profile of a predetermined magnitude and duration, the striker release element rotates towards the base to release an engagement between the first and second surfaces and allow the striker mass to rotate under a biasing force of the second biasing element.

19 Claims, 9 Drawing Sheets

COMPACT AND MECHANICAL INERTIAL IGNITERS FOR THERMAL BATTERIES AND THE LIKE FOR MUNITIONS WITH SHORT DURATION FIRING SETBACK SHOCK

BACKGROUND OF THE INVENTION

1. Field of the Invention

The present invention relates generally to mechanical inertial igniters, and more particularly to compact, low-volume, reliable and easy to manufacture mechanical inertial igniters and ignition systems for thermal batteries and the like used in munitions with relatively short duration firing setback acceleration (shock).

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand or semi-automatically. Other manufacturing processes have also been recently developed that are more amenable to automation. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low firing setback or the like acceleration (shock) levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

The need to differentiate accidental and other so-called no-fire events from the so-called all-fire event, i.e., the firing setback acceleration (shock) event necessitates the employment of a safety system which is capable of allowing initiation of the inertial igniter only when the inertial igniter is subjected to the impulse level threshold corresponding to or above the minimum all-fire impulse levels. The safety mechanism can be thought of as a mechanical delay mechanism, after which a separate initiation system is actuated or released to provide ignition of the inertial igniter pyrotechnics. An inertial igniter that combines such a safety system with an impact based initiation system and its alternative embodiments are described herein.

Inertia-based igniters must therefore comprise two components so that together they provide the aforementioned mechanical safety (delay mechanism) and to provide the required striking action to achieve ignition of the pyrotechnic element(s) of the inertial igniter. The function of the safety system (mechanism) is to hold the striker element fixed to the igniter structure until the inertial igniter is subjected to a high enough acceleration level with long enough duration, i.e., to a prescribed impulse level threshold, corresponding to the firing setback acceleration event. The prescribed impulse level threshold requirement is generally accompanied also with a minimum acceleration level requirement to ensure that the inertial igniter is safe, i.e., the striker element stays fixed to the inertial igniter structure, when subjected to relatively low acceleration levels for relatively long duration. Once the all-fire event, i.e., the said minimum acceleration level and the prescribed impulse level threshold has been reached, the said safety system (mechanism) releases the striker element, allowing it to accelerate toward its target. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

A schematic of a cross-section of a conventional thermal battery and inertial igniter assembly is shown in FIG. 1. In thermal battery applications, the inertial igniter 10 (as assembled in a housing) is generally positioned above the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height.

The isometric cross-sectional view of a currently available inertia igniter is shown in FIG. 2, referred to generally with reference numeral 200. The full isometric view of the inertial igniter 200 is shown in FIG. 3. The inertial igniter 200 is constructed with igniter body 201, consisting of a base 202 and at least three posts 203. The base 202 and the at least three posts 203, can be integrally formed as a single piece but may also be constructed as separate pieces and joined together, for example by welding or press fitting or other methods commonly used in the art. The base 202 of the housing can also be provided with at least one opening 204 (with a corresponding opening(s) in the thermal battery—not shown) to allow ignited sparks and fire to exit the inertial igniter and enter into the thermal battery positioned under the inertial igniter 200 upon initiation of the inertial igniter pyrotechnics 215, or percussion cap primer when used in place of the pyrotechnics 215 (not shown). Although illustrated with the opening 204 in the base, the opening (or openings) can alternatively be formed in a side wall or in the striker mass as described in U.S. Patent Application Publication No. 2011/0171511 filed on Jul. 13, 2010, the entire contents thereof is incorporated herein by reference.

A striker mass 205 is shown in its locked position in FIG. 2. The striker mass 205 is provided with guides for the posts 203, such as vertical surfaces 206, that are used to engage the corresponding (inner) surfaces of the posts 203 and serve as guides to allow the striker mass 205 to ride down along the length of the posts 203 without rotation with an essentially pure up and down translational motion.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which is preferably in compression, is also provided around but close to the posts 203 as shown in FIGS. 2 and 3. In the configuration shown in FIG. 2, the locking balls 207 are prevented from moving away from their aforementioned locking position by the collar 211. The setback spring 210 is preferably a wave spring with rectangular cross-section. The collar 211 is usually provided with partial guide 212 ("pocket"), which are open on the top as indicated by the numeral 213. The guide 212 may be provided only at the location of the locking balls 207 as shown in FIGS. 2 and 3, or may be provided as an internal surface over the entire inner surface of the collar 211 (not shown).

The collar 211 rides up and down on the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would "lock" the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In the inertial igniters of the type shown in FIGS. 2 and 3, a one part pyrotechnics compound 215 (such as lead styphnate or other similar compound) is used as shown in FIG. 2. The striker mass 205 is usually provided with a relatively sharp tip 216 and the igniter base surface 202 is provided with a protruding tip 217 which is covered with the pyrotechnics compound 215, such that as the striker mass 205 is released during an all-fire event and is accelerated down (opposite to the arrow 218 illustrated in FIG. 2), impact occurs mostly between the surfaces of the tips 216 and 217, thereby pinching the pyrotechnics compound 215, thereby providing the means to obtain a reliable initiation of the pyrotechnics compound 215. Alternatively, a two-part pyrotechnics compound consisting, for example, one being based on potassium chlorate used in place of the pyrotechnics 215 and the other based on red phosphorous which is positions over a (generally larger) tip 216 of the striker mass 206, may be used. In another alternative design, instead of using the pyrotechnics compound 215, FIG. 2, a percussion cap primer or the like (not shown) is used. In such inertial igniters, the tip 216 of the striker mass 205 is appropriately sized for initiating the percussion cap primer being used.

The basic operation of the inertial igniter 200 shown in FIG. 2 and is as follows. Any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If an acceleration time in the axial direction 218 imparts a sufficient impulse to the collar 211 (i.e., if an acceleration time profile is greater than a predetermined threshold), it will translate down along the axis of the assembly until the setback locking balls 205 are no longer constrained to engage the striker mass 205 to the posts 203. If the acceleration event is not sufficient to provide this motion (i.e., the acceleration time profile provides less impulse than the predetermined threshold), the collar 211 will return to its start (top) position under the force of the setback spring 210.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 moves downward, causing the tip 216 of the striker mass 205 to strike the pyrotechnic compound 215 on the surface of the protrusion 217 with the requisite energy to initiate ignition.

In the inertial igniter 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one (not shown) to guide the ignition flame and sparks up through the striker mass 205 to allow the pyrotechnic materials (or the like) of a thermal battery (or the like) positioned above the inertial igniter 200 to be initiated.

In the inertial igniter 200 of FIGS. 2 and 3, by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 has to travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

In general, the required acceleration time profile threshold for inertial igniter initiation, i.e., the so-called all-fire condition, is described in terms of an acceleration pulse of certain amplitude and duration. For example, the all-fire acceleration pulse may be given as being 1000 G for 15 milliseconds. The no-fire (no-initiation) condition may be indicated similarly with certain acceleration pulse (or half-sine) amplitude and duration. For example, the no-fire condition may be indicated as being an acceleration pulse of 2000 G for 0.5 milliseconds. Other no-fire conditions may include transportation induced vibration, usually around 10 G with a range of frequencies.

It is appreciated by those skilled in the art that when the inertial igniter 200 of FIGS. 2 and 3 is subjected to the aforementioned all-fire acceleration profile threshold, the collar 211 is first caused to be displaced downward under the force caused by the acceleration in the direction of the arrow 218 acting on the inertia (mass) of the collar 211, until the striker mass 205 is released as was described above and accelerated downward to towards the base 202 of the inertial igniter until the tip 216 of the striker mass 205 strikes the pyrotechnic material 215 over the protruding tip 217 and causing it to ignite. It is also appreciated by those skilled in the art that the process of downward travel of the collar 211 takes a certain amount of time, hereinafter indicated as $\Delta t_1$, the amount of which is dependent on the mass of the collar 211 and the aforementioned preloading level of the compressive spring 210 and the distance that it has to travel downward before the balls 207 and thereby the striker mass 205 is released. Similarly, once the striker mass 205 is released, the process of downward travel of the striker mass 205 until its tip 216 strikes the pyrotechnic material 215 over the protruding tip 217 takes a certain amount of time for, hereinafter indicates as $\Delta t_2$, the amount of which is dependent on the level of acceleration in the direction of the arrow 218.

In addition, in recent years new improved chemistries and manufacturing processes have been developed that promise the development of lower cost and higher performance thermal batteries that could be produced in various shapes and sizes, including their small and miniaturized versions. However, inertial igniters are relatively large and not suitable for small and low power thermal batteries, particularly those that are being developed for use in miniaturized fuzing, future smart munitions, and other similar applications. This is general the case for munitions with relatively low firing setback acceleration, particularly those in which the firing setback acceleration pulse (shock) has relatively short duration.

It is therefore appreciated by those skilled in the art that the duration of the all fire acceleration must at least be the sum of the above two time periods $\Delta t_1$ and $\Delta t_2$, hereinafter indicated as $\Delta t=\Delta t_1+\Delta t_2$. For example, for the aforementioned case of all-fire (setback) acceleration being 1000 G for 15 milliseconds, the total time $\Delta t$ must be less than the indicated acceleration duration of 15 milliseconds.

In certain applications, the aforementioned total time $\Delta t$ is small enough that even by optimizing the parameters design of the inertial igniter of the type shown in FIGS. 2 and 3 to minimize the required aforementioned time periods $\Delta t_1$ and $\Delta t_2$, the required total time $\Delta t$ cannot be reduced to below the all-fire acceleration period.

In certain other case, due to the small size or geometry of the thermal battery or the like, the height of the inertial igniter that can be used is so small that the striker mass 205 upon its release does not have enough distance to travel downward to gain enough velocity (i.e., enough kinetic energy) before its tip 216 strikes the pyrotechnic material 215 over the protruding tip 217 in order to be able to cause the pyrotechnic material 215 to be reliably ignited.

SUMMARY OF THE INVENTION

A need therefore exists for novel miniature inertial igniters that can be used in munitions or the like for initiation of pyrotechnic materials in thermal batteries or the like in which the aforementioned all-fire acceleration profile is very short in duration as is described above for inertial igniters of the type shown in FIGS. 2 and 3 to be used.

A need also exists for small inertial igniters that can initiate thermal batteries used in munitions with relatively low firing setback acceleration levels that may also be of short duration.

There is also a need for inertial igniters that can be used to initiate thermal batteries or the like in munitions or the like when the height available in munitions is too small as is described above for inertial igniters of the type shown in FIGS. 2 and 3 to be used.

Such inertial igniters must be safe and do not initiate when subjected no-fire conditions. In general, such inertial igniters are also required to withstand the harsh firing environment, while being able to be designed to ignite at specified acceleration levels when subjected to such accelerations for a specified amount of time to match the firing acceleration experienced. Very high reliability is also of much concern. The inertial igniters must also usually have a shelf life of up to 20 years and could generally be stored at temperatures of sometimes in the range of −65 to 165 degrees F. This requirement is usually satisfied best if the igniter pyrotechnic is in a sealed compartment. The inertial igniters must also consider the manufacturing costs and simplicity in design to make them cost effective for munitions applications.

To ensure safety and reliability, inertial igniters should not initiate during acceleration events which may occur during manufacture, assembly, handling, transport, accidental drops, etc. Additionally, once under the influence of an acceleration profile particular to the firing of ordinance from a gun, the device should initiate with high reliability. It is also conceivable that the igniter will experience incidental low but long-duration accelerations, whether accidental or as part of normal handling, which must be guarded against initiation.

Those skilled in the art will appreciate that the inertial igniters disclosed herein may provide one or more of the following advantages over prior art inertial igniters:

provide small inertial igniters that can be initiated when subjected to very short duration firing setback acceleration (shock);

provide small inertial igniters that can be initiated when subjected to relatively low firing setback acceleration (shock);

provide small inertial igniters that can be initiated when subjected to relatively low firing setback acceleration (shock) with relatively short duration;

provide inertial igniters that are significantly shorter than currently available inertial igniters for thermal batteries or the like;

provide inertia igniters that could be constructed to guide the pyrotechnic flame essentially downward (in the direction opposite to the direction of the firing acceleration—usually for mounting on the top of the thermal battery as shown in FIG. 1), or essentially upward (in the direction opposite of the firing acceleration—usually for mounting at the bottom of the thermal battery);

Accordingly, inertial igniters and ignition systems for use with thermal batteries or the like upon subjection to firing setback acceleration, in particular short duration and/or relatively low peak acceleration levels, are provided. Provided are also inertial igniters that are very low height for small thermal batteries.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
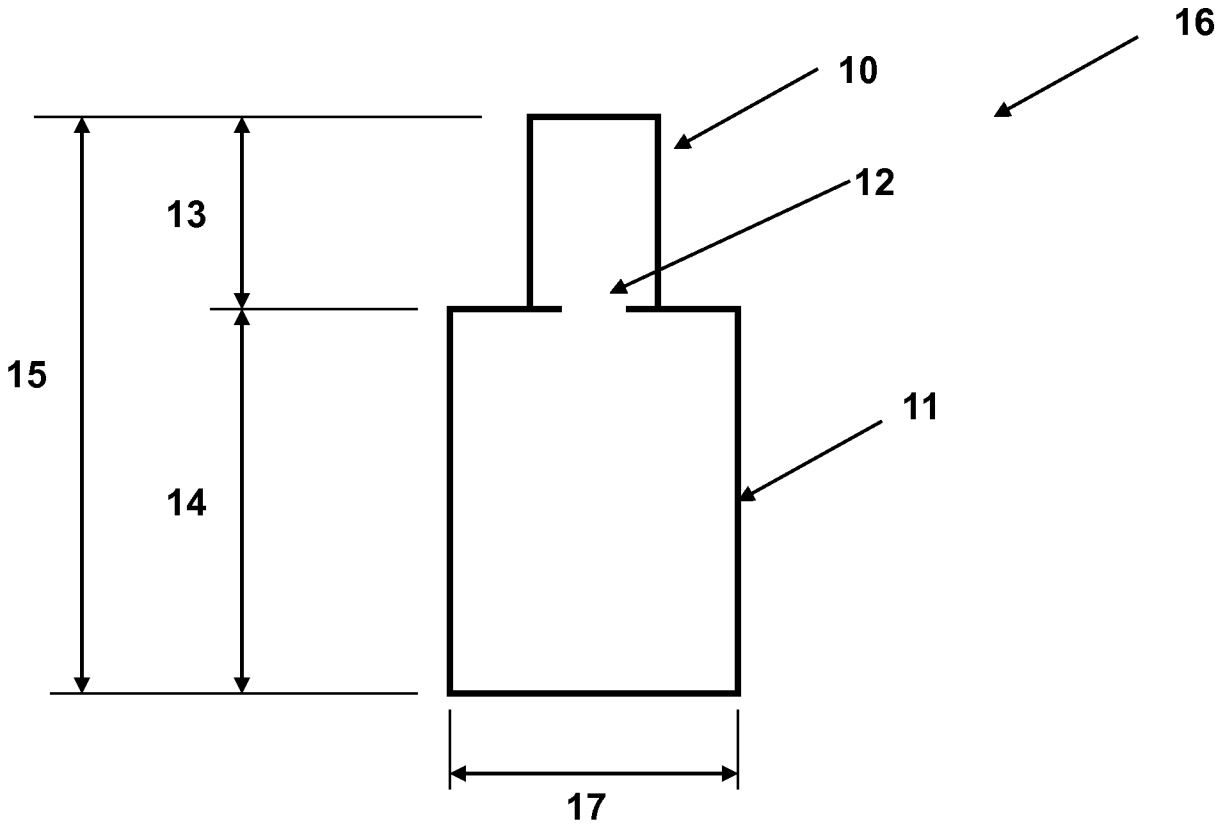
Figure 1 (PRIOR ART)
FIG. 1 illustrates a schematic of a cross-section of a thermal battery and inertial igniter assembly.
Figure 2:
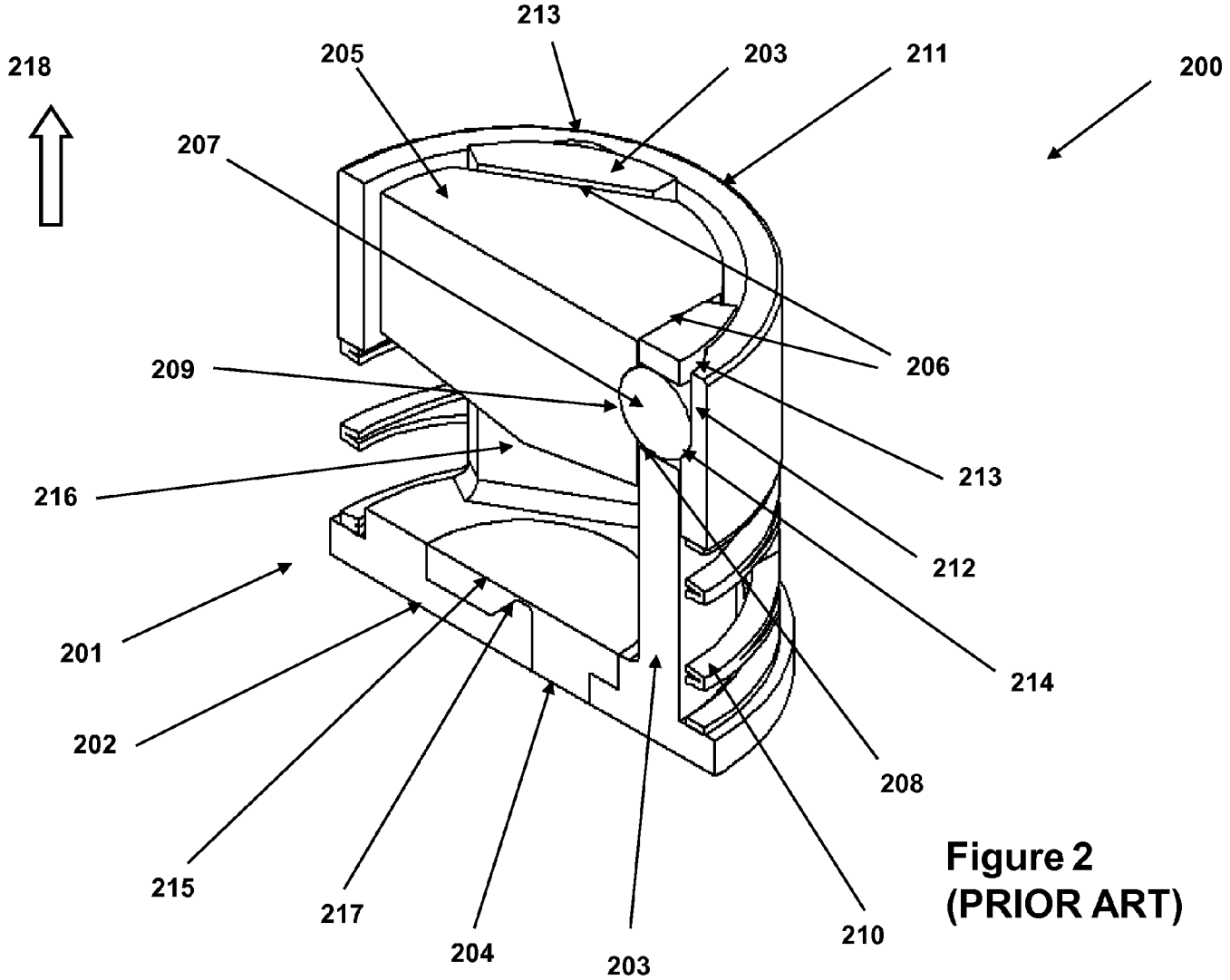
Figure 2 (PRIOR ART)
FIG. 2 illustrates an isometric cut away view of an inertial igniter assembly known in the art.
Figure 3:
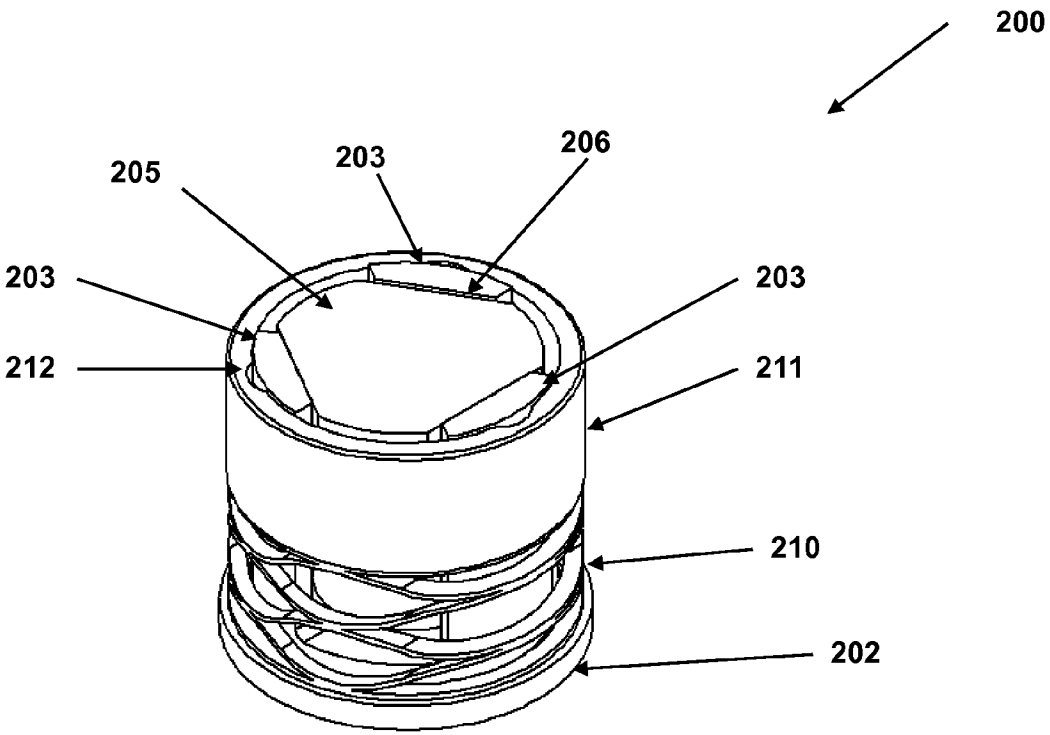
Figure 3 (PRIOR ART)
FIG. 3 illustrates a full isometric view of the prior art inertial igniter of FIG. 2.
Figure 4:
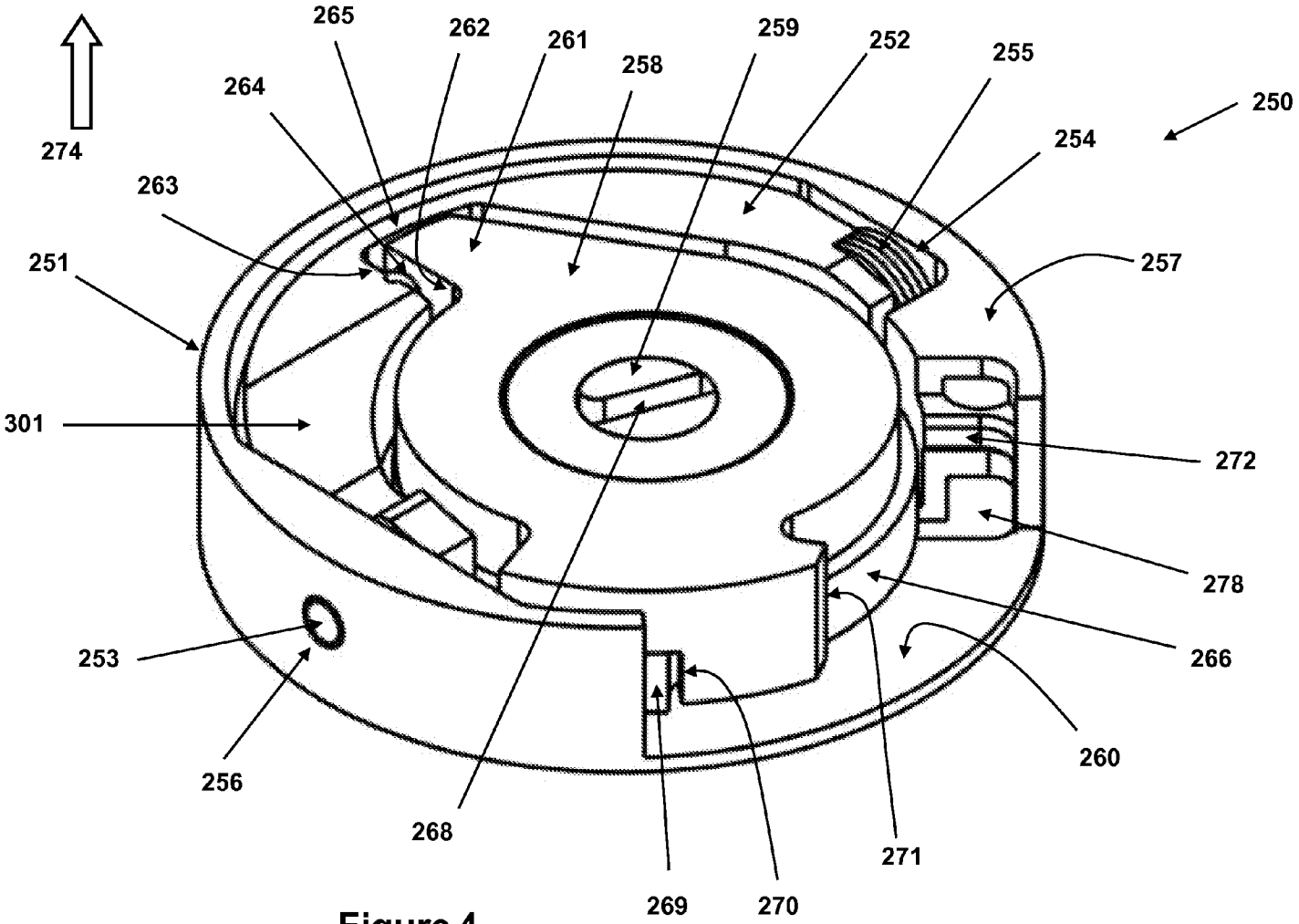
FIG. 4 illustrates a full isometric view of a first embodiment of an inertial igniter in a locked position.

A schematic of the isometric view of a first embodiment of an inertia igniter is shown in FIG. 4, referred to generally with reference numeral 250. In the isometric view of FIG. 4 the inertial igniter body 251 of the inertial igniter 250 is shown as being transparent to enable the internal components of the device to be seen. A lever type striker release element 252 is provided which is rotationally hinged to the inertial igniter body 251 by the pins 253 and 254. One or both pins 253 and 254 may be fixed to the inertial igniter body 251, preferably through press fitting or otherwise using adhesives such as epoxy or by soldering or brazing or by welding or the like, particularly if the joint needs to be hermetically sealed. When any one of the pins 253 or 254 is fixed to the inertial igniter body, then the corresponding hole 252*a* in the striker release element 252 is provided with enough clearance to allow free rotation of the striker release element 252 relative to the inertial igniter body about the long axes of the pins 253 and 254. In an embodiment, the pins 253 and 254 are fixed to the inertial igniter body, where the fixing process can be achieved by press fitting the pins into holes 256 provided in the inertial igniter body 251 during the inertial igniter assembly process. Alternatively, one or both pins 253 and 254 are fixed to the striker release element 252 using one of the aforementioned methods and enough clearance is provided in the holes 256 in the inertial igniter body to allow free rotation of the striker release element 252 relative to the inertial igniter body about the long axes of the pins 253 and 254.

The striker release element 252 is rotationally biased upward by at least one preloaded torsion spring 255, which is positioned at one or both rotating joints with pins 253 and/or 254 as shown in FIG. 4. The upward rotation of the striker release element 252 past the top surface 257 of the inertial igniter 250 can be prevented by a stop (not shown) for ease of inertial igniter assembly into the intended device (usually a thermal battery or the like), or by a top inertial igniter cover (not shown), which can be provided by the thermal battery assembly itself to minimize the total height of the inertial igniter.

Figure 5:
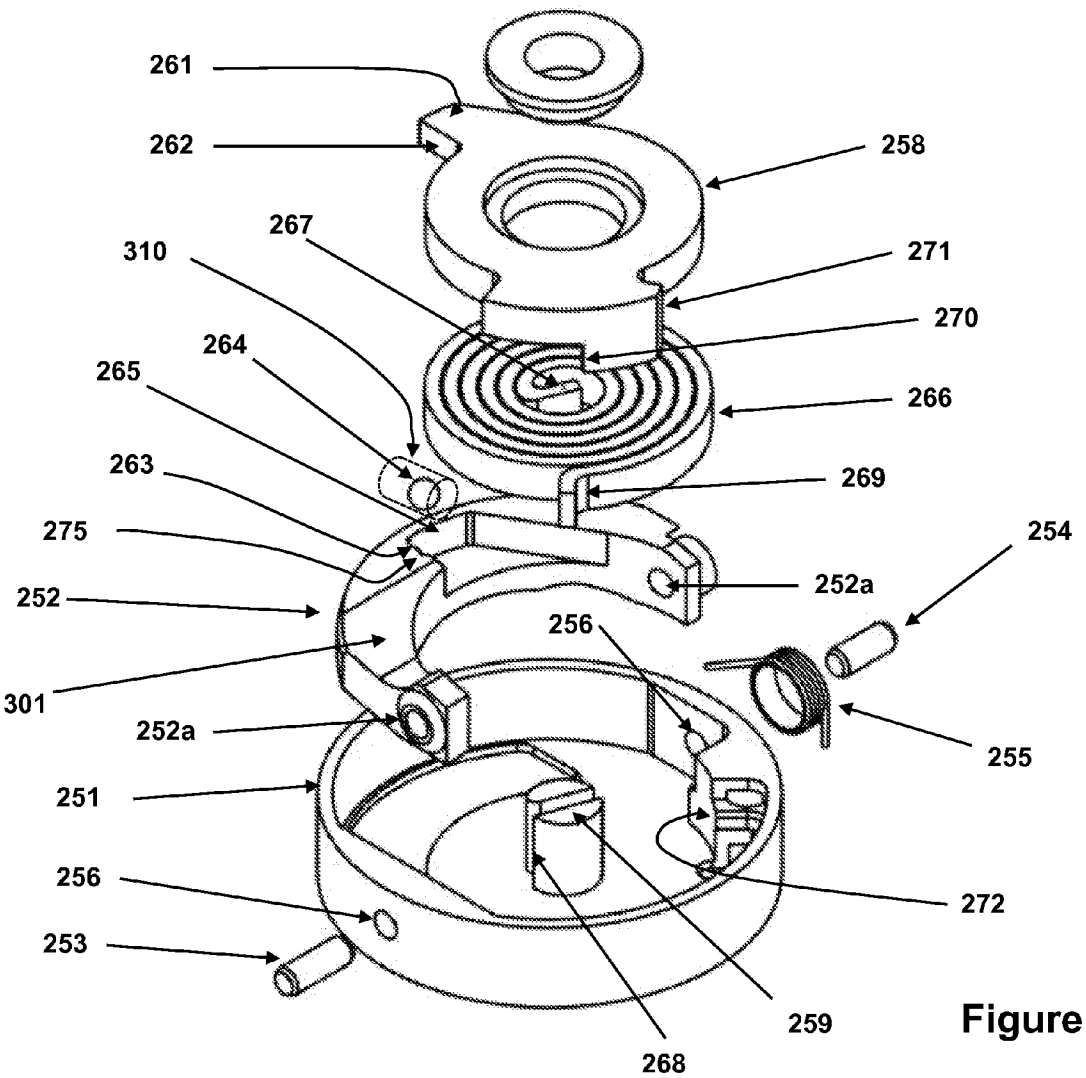
FIG. 5 illustrates a blow up view of the first embodiment of the inertial igniter of FIG. 4 showing all its individual components.

The inertial igniter 250 is provided with a rotating striker mass 258, which is free to rotate about the cylindrical post 259, which is provided on the base 260 of the inertial igniter body 251 as shown in FIGS. 4 and 5.

The rotating striker mass 258 is provided with a tip portion 261 with a vertical face 262, which faces a matching (vertical) face 263 provided in the recess 265 on the striker release element 252. In the pre-activation state, the two surfaces 262 and 263 are pressed against each other (sometimes via a ball element 264—as later described) by a preloaded torsion spring 266. A dimple 275 is provided on the contact surface 263 of the striker release element 252 to keep the ball 264 in its indicated position on the contact surface 263. The dimple 275 can be provided on the contact surface 263 of the striker release element 252, but could alternatively be provided on the contact surface 262 of the rotating striker mass 258. The inner end of the spring 266 is fixed to the cylindrical post 259, by fitting its extended end 267, FIG. 5, inside the slot 268 provided on the cylindrical post 259 as can be seen in FIGS. 4 and 5. The other end 269 of the torsion spring 266 is positioned against a vertical surface 270 that is provided under the rotating striker mass 258. In the pre-activation state shown in FIG. 4, the torsion spring is preloaded (wound) such that it would tend to rotate the rotating striker mass in the counterclockwise direction as seen in FIG. 4, thereby causing the surfaces 262 and 263 to be pressed against each other. In an embodiment, the torsion spring 266 is designed and assembled in the inertial igniter 250 such that the preloading action causes the torsion spring spiral to close. Such a direction of preloading of the torsion spring 266 is preferred since in such a preloading state the spring element is more stable.

As shown in FIGS. 4 and 5, the rotating striker mass 258 is also provided with a sharp vertical ridge 271, with a relatively small flat face, which can run along an entire length (downward) of the rotating striker mass 258. Inside the igniter body 251 is also provided with an opposing and preferably horizontal ridge 272, which is also provided with a relatively small flat face. The inertial igniter (one part) pyrotechnic material 273 (shown with dashed lines in FIG. 8) is used to cover the surface of the horizontal ridge 272 with a relatively thin layer, with the bulk of pyrotechnic material being deposited on the surfaces around the horizontal ridge 272 shown in FIG. 5.

The basic operation of the inertial igniter 250 will now be described with reference to FIGS. 4 and 5. Any non-trivial acceleration in the axial direction in the direction or opposite to the direction of the arrow 274 acts on the inertia of the striker release element 252, generating a torque that would tend to rotate the striker release element 252 downward or upward, respectively. If the acceleration in the direction of the arrow 274 is high enough to generate a torque that overcomes the preloaded torque of the torsion spring 255, then the striker release element 252 would rotate certain amount downwards. The upward rotation of the striker release element 252 is prevented by the aforementioned stop element (not shown) or the top cover of the inertial igniter 250 (not shown). However, if the non-trivial acceleration in the direction of the arrow 274 is not high enough and its duration is not long enough, i.e., if it is not at or above the prescribed all-fire event, then the striker release element 252 would return to its pre-acceleration (original) position shown in FIG. 4.

If an acceleration in the direction of the arrow 274 at or above the all-fire acceleration level and its duration is also at or above the all-fire acceleration duration, then a sufficient impulse is imparted to rotate the striker release element 252 downward enough to cause the contact surface 263 of the striker release element 252 to move below the contact surface 262 of the rotating striker mass 258. The torque of the preloaded torsion spring 266 will then cause the rotating striker mass 258 to be accelerated rotationally in the counterclockwise direction as observed from the top of the inertial igniter 250, FIG. 4. The rotating striker mass will keep gaining rotational velocity, thereby rotational energy, until its sharp vertical ridge 271 strikes the pyrotechnic material 273 covering the horizontal ridge 272 provided inside the igniter body 251. The level of preloading of the torsion spring 266 and the moment of inertia of the rotating striker mass 258 are selected such that as the sharp vertical ridge 271 strikes the pyrotechnic material 273 covering the horizontal ridge 272, it has an appropriate level of energy to ignite the pyrotechnic material. The resulting flames and sparks will then exit from the provided exit hole 278.

In general, a recess 301 is provided in the top surface of the striker release element 252 over which the released rotating striker mass 258 travels as shown in FIGS. 4 and 5 to minimize the total height of the inertial igniter 250.

Figures 6A, 6B:
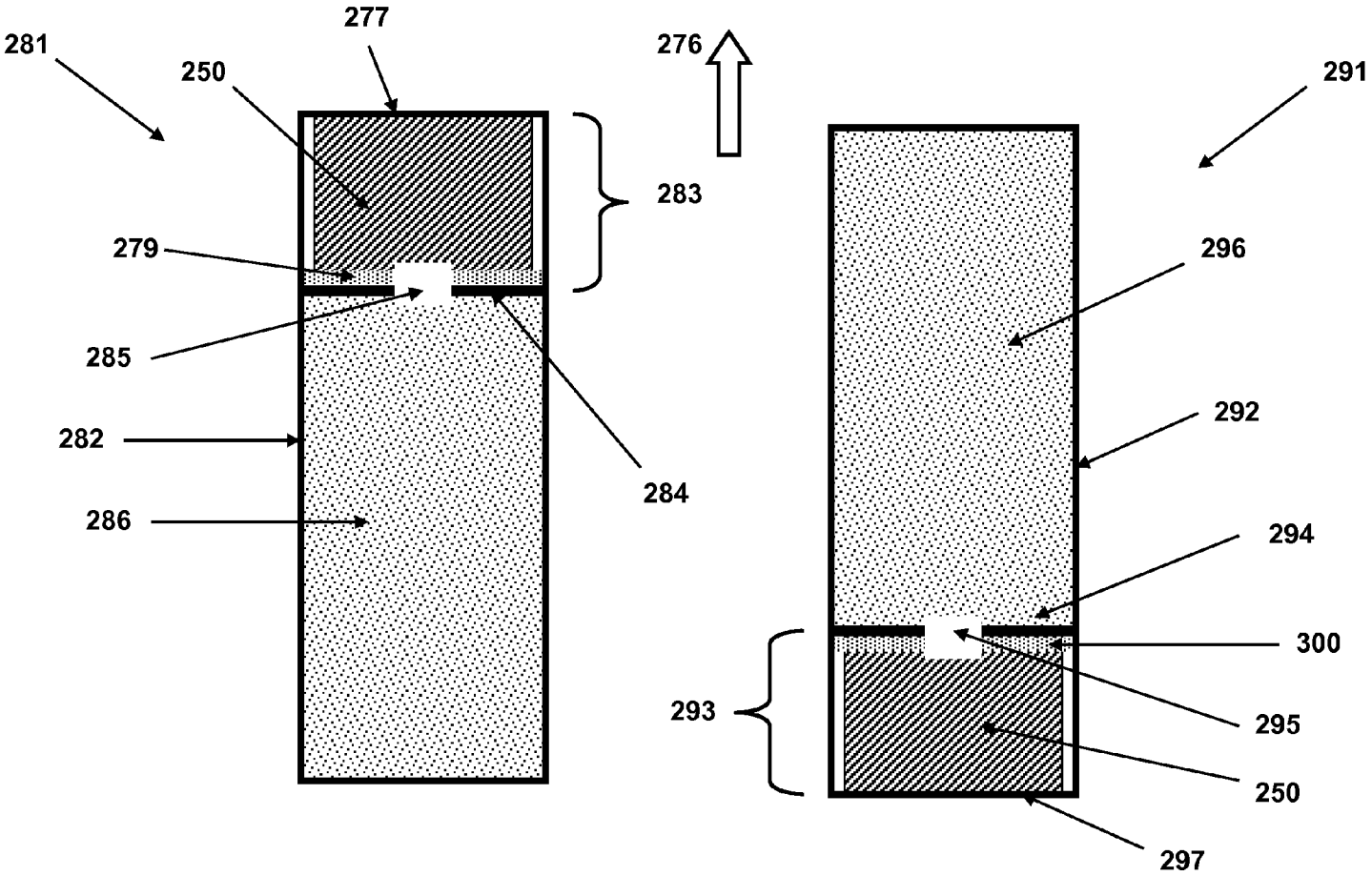
FIGS. 6*a* and 6*b* illustrate first and second variations of thermal battery and inertial igniter assemblies.

In FIG. 4, the inertial igniter embodiment 250 is shown without any outside housing. In many applications, as shown in the schematics of FIG. 6*a*, the inertial igniter 250 (FIG. 4) is placed securely inside a top housing 283 of the thermal battery 281. Here, the thermal battery is considered to be subjected to all-fire setback firing acceleration in the direction of the arrow 276. In such a thermal battery assembly, the top surface of the inertial igniter is covered (either by the top cap 277 of the thermal battery, FIG. 6*a*, or an inertial igniter top cover—not shown in FIG. 4), and the ignition flame and sparks are routed through the opening 278 provided on the bottom surface 260 of the inertial igniter 250 as shown in FIG. 4. In addition, depending on the location of the opening 285 in the bottom surface 284 of the inertial igniter compartment 283 relative to the inertial igniter flame and spark exit opening 278, a strip of intermediate ignitable material 279 such as so-called heat paper may be used to facilitate ignition of the thermal battery heat generating pyrotechnic material inside the housing 282 of the thermal battery cell 286.

Figure 9:
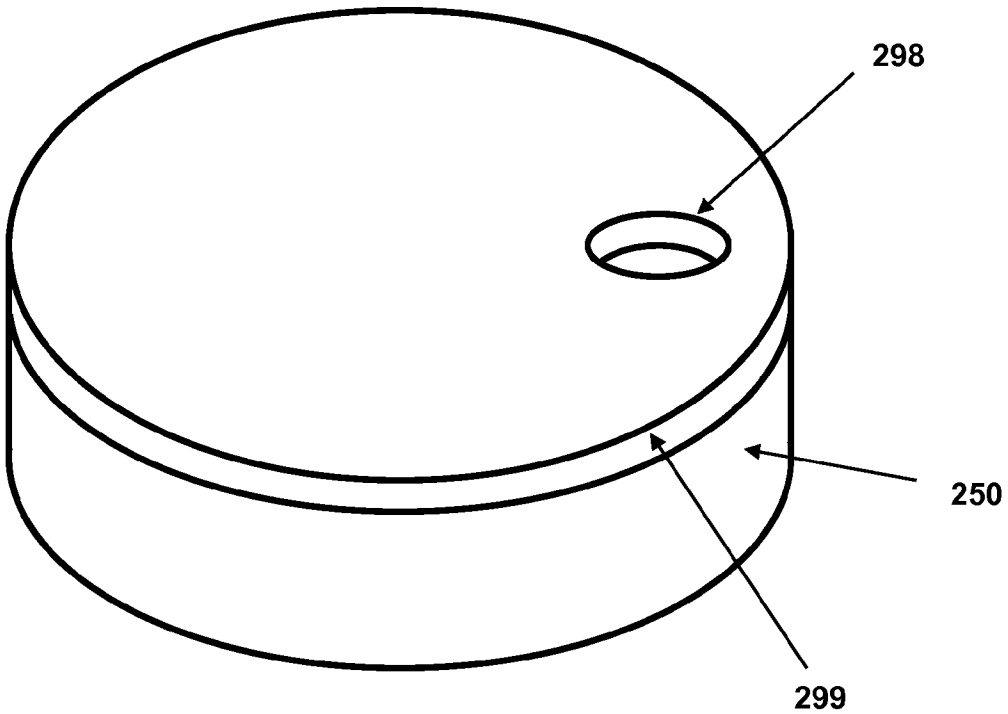
FIG. 9 illustrates the inertial igniter embodiment of FIG. 4 with a provided cover element with a ignition flame and spark exit hole.

In other applications, as shown in the schematics of FIG. 6*b*, the inertial igniter 250 (FIG. 4) is placed securely inside a bottom housing 293 of the thermal battery 291. Here, the thermal battery is also considered to be subjected to all-fire setback firing acceleration in the direction of the arrow 276. In such a thermal battery assembly, the top surface of the inertial igniter is covered by bottom surface 297 of the thermal battery, FIG. 6*b*, and the ignition flame and sparks are routed through an opening provided 298 on the inertial igniter top cover 299 (shown in FIG. 9). In addition, depending on the location of the opening 295 on the surface 294 of the inertial igniter compartment 293 relative to the inertial igniter flame and spark exit opening 298, a strip of intermediate ignitable material 300 such as so-called heat paper may be used to facilitate ignition of the thermal battery heat generating pyrotechnic material inside the housing 292 of the thermal battery cell 296.

Figure 7:
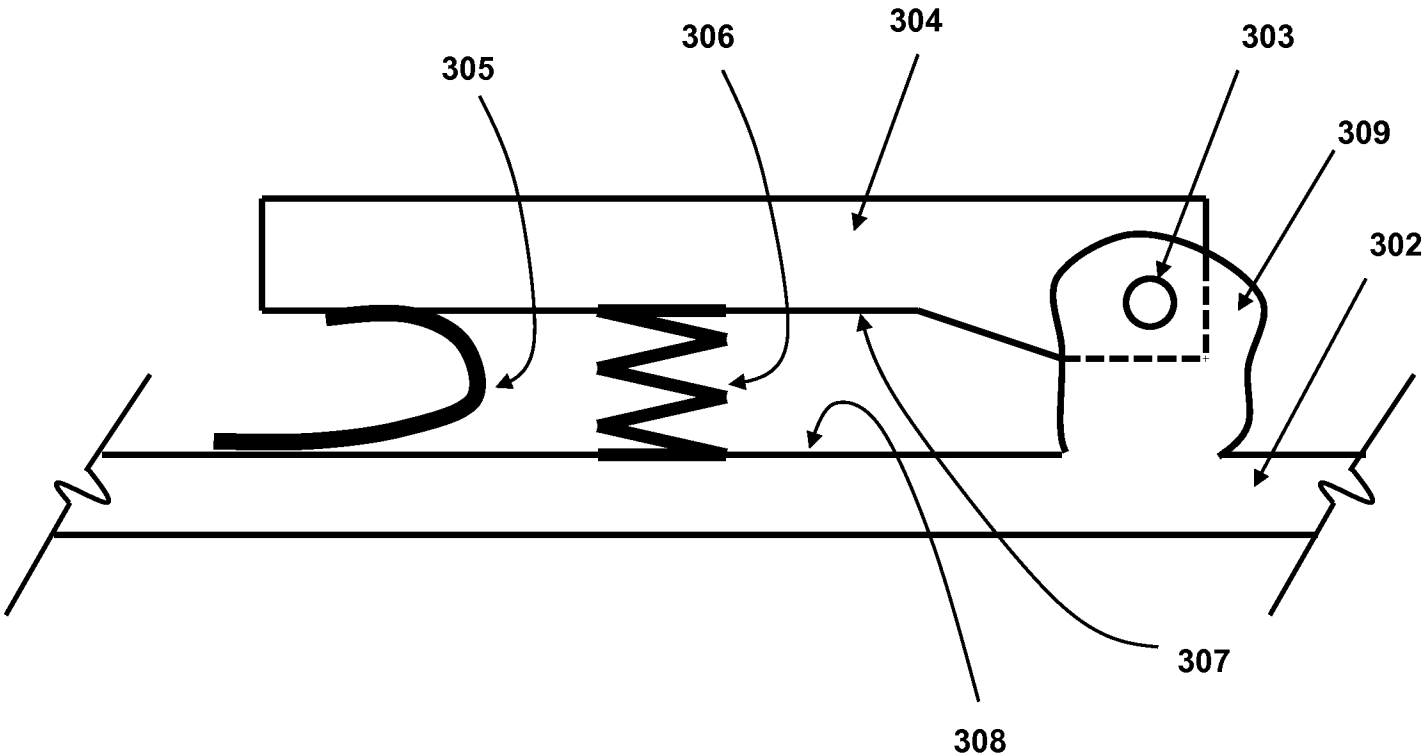
FIG. 7 illustrates the alternative options for the biasing compressive springs for the striker release element of the inertial igniter embodiment of FIG. 4.

In the inertial igniter embodiment 250 of FIG. 4, the at least one preloaded torsion spring 255, which is positioned at one or both rotating joints with pins 253 and/or 254, was described as being used to bias the striker release element 252 upward rotation against a stop (not shown) for ease of inertial igniter assembly into the intended device (usually a thermal battery or the like), or against a top inertial igniter cover (not shown). It is, however, appreciated by those skilled in the art that alternatively, the torsion spring 255 may be replaced by a compressively preloaded spring as is shown in FIG. 7. In FIG. 7, a simplified side view (as viewed in the direction of the axis of rotation of the rotary joints with pins 253 and 254) is shown with only a partial view of the housing 251 (302 in FIG. 7) of the inertial igniter 250 of FIG. 4, with most of the housing wall removed except the portion containing the rotary joint accommodating the joint pin 253 (303 in FIG. 7) for simplification of the view. In FIG. 7, the simplified view of the striker release element 304 (252 in FIG. 4) is shown in its normal (in non-initiated inertial igniter) position. The striker release element 304 attached to the inertial igniter housing side wall 309 by the rotary joint pin 303. The stop element that prevents further clockwise rotation of the striker release element 304 from its position seen in FIG. 7 is not shown for clarity.

The aforementioned upward biasing compressively loaded spring may be a regular helical spring (which can be a wave spring type) 306 or a flat spring 305 formed of a strip of spring steel or the like. Either compressively preloaded springs 305 or 306 are positioned between the bottom surface 307 of the striker release element 304 and the top surface 308 of the inertial igniter housing 302. In general, the compressively preloaded springs 305 or 306 are mounted within provided detents and/or protrusions on one or both surfaces 307 and 308 (not shown) to keep the springs 305 or 306 in place and prevent them from moving inside the inertial igniter assembly. An advantage of using such compressively preloaded biasing springs 305 or 306 (such as a formed flat spring 305 type) is that they would exert an upward force to the bottom surface 307 of the striker release element 304, thereby generating a nearly pure rotating torque to the striker release element 304, thereby minimizing the chances of generating increased friction forces at its rotating joints. The other advantage is that it significantly reduces assembling complexity, thereby the production cost of the inertial igniter.

In FIG. 4, in the schematic of the inertial igniter 250, the rotating striker mass 258 is shown to be provided with a tip portion 261 with a vertical face 262, which faces the matching (vertical) face 263 provided in the recess 265 on the striker release element 252. As it was previously described, in the pre-activation state, the two surfaces 262 and 263 are pressed against each other by the preloaded torsion spring 266. In the schematic of FIG. 4, a ball 264 is shown to be positioned (on one side within the dimple 275) between the surfaces 262 and 263, the reason of which is to facilitate the relative sliding motion between the two surfaces by minimizing friction between the two surfaces as the inertial igniter is subjected to all-fire condition. It is, however, appreciated by those skilled in the art that other means and methods may also be used to minimize friction between the sliding surfaces 262 and 263 to facilitate downward rotation of the striker release element 252, including the following.

In one alternative embodiment, a rolling element (shown in dashed lines in FIG. 5 and enumerated as 310) is used in place of the aforementioned ball 264. A dimple similar to the dimple 275 shown in FIG. 5 but shaped to accommodate the roller 300 is also provided to secure the roller in the inertial igniter assembly.

In another alternative embodiment, the aforementioned ball 264 is not used and the two surfaces 262 and 263, FIG. 4, are allowed to come into contact. In this embodiment, the two surfaces 262 and 263 can be provided with certain curvature (not shown) to avoid sharp corners scraping between the two surfaces as the striker release element 252 rotates downward to release the rotating striker mass 258. The contacting surfaces may further be coated by friction reducing materials (lubricants) such as graphite, Teflon or the like (liquid lubricants are usually not desirable due to the required very long shelf life of up to 20 years). One or both surfaces may also be coated with hard materials such as tungsten or the like.

In yet another alternative embodiment, the aforementioned ball 264 is not used between the two surfaces 262 and 263, FIG. 4. To facilitate sliding action between the two surfaces, a thin sheet of friction reducing material (not shown) such as one made out of Teflon or a hard and polished metal or ceramic or the like is provided between the two surfaces 262 and 263. The provided friction reducing material may be fixed to one of the surfaces 262 or 263 to prevent it from being pushed out or fall off.

The alternative embodiments of the inertial igniter 250 designs have the purpose of reducing friction to the downward rotation of the striker release element 252 as it is rotated under the prescribed all-fire condition to release the rotating striker mass 258. Other sources of friction that resist the downward rotation of the striker release element 252 are friction at the rotating joints with pins 253 and 254, where friction exists between the pin surfaces and the mating joint surfaces as well as between the side surfaces of the striker release element 252 and their contacting surfaces on the inertial igniter housing. To reduce the effects (i.e., the generated resisting torque to the downward rotation of the striker release element 252), the diameters of the pins 253 and 254 can be small and the contacting surfaces can be coated with friction reducing "lubricating" materials and/or provided with intermediate low friction "washer" type relatively thin members.

Figure 8:
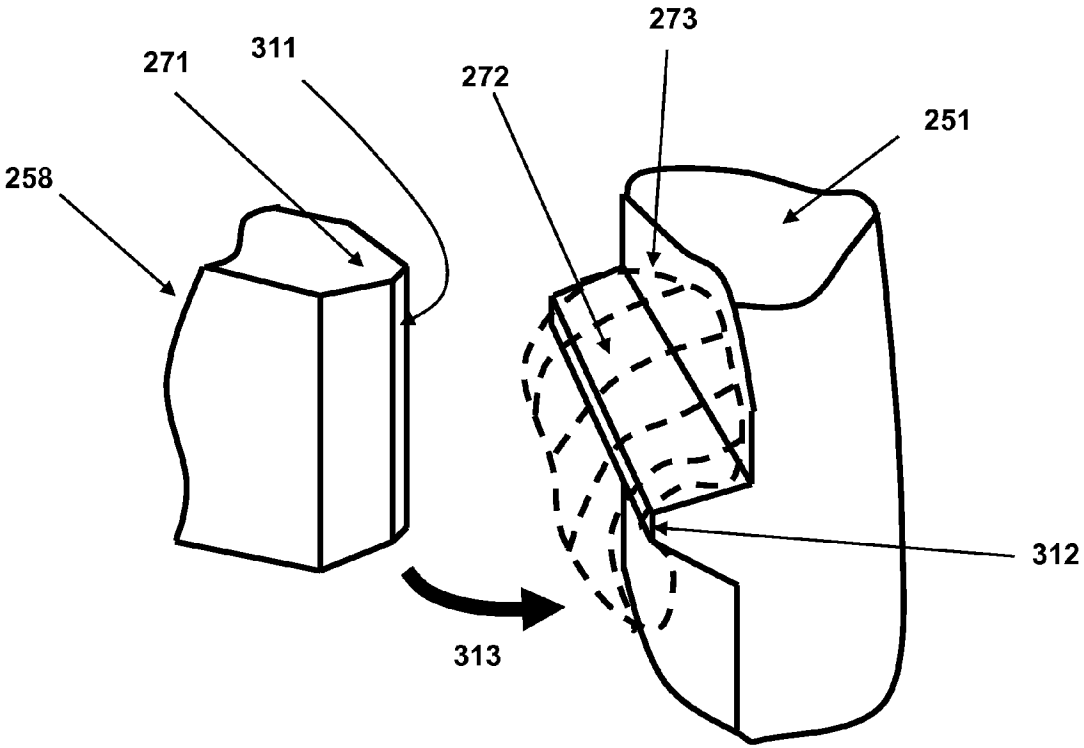
FIG. 8 illustrates the pyrotechnic region of the inertial igniter of FIG. 4 with impacting ridges that ensure reliable initiation of the pyrotechnic material.

As is shown in FIGS. 4 and 5, the rotating striker mass 258 is provided with a sharp vertical ridge 271, which can have a relatively small flat face 311, which can run along the entire length of the rotating striker mass 258 as shown in the partial view FIG. 8. Inside the igniter body 251 was also shown to be provided with an opposing and preferably horizontal ridge 272, which is also provided with a relatively small flat face 312. In FIG. 8, a partial view of the inertial igniter 250, FIGS. 4 and 5, showing the ridges 271 and 272 with their frontal flat surface 311 and 312, respectively, is shown. In the schematic of FIG. 8 the one part pyrotechnic material 273, which can be based on lead styphnate or other similar compounds, and is used to cover the surface of the horizontal ridge 272 (shown in FIG. 5 but not shown in FIG. 4 for clarity) is not shown. In general, the portion of the pyrotechnic material covering the flat surface portion 312 of the horizontal ridge 272 is in a relatively thin layer. Then as the rotating striker mass 258 is released, its ridge 271 portion is accelerated towards the ridge 272 and impacts it at a certain point. In this design, since the two flat surfaces 311 and 312 are positioned at about 90 degrees relative to each other, the resulting impacting surface is always close to a rectangle with sides equal to the widths of the two flat surfaces 311 and 312. As a result, the inertial igniter parts do not have to have extremely high precision to allow the pyrotechnic igniting impact to occur over a relatively small area. In general, it is highly desirable to have a relatively small area of impact, within which a thin layer of pyrotechnic material is impinged during impact to ensure reliable pyrotechnic initiation.

In the schematics of FIGS. 4, 5 and 8, the impacting ridges 271 and 272 of the inertial igniter 250 were shown to be vertical and horizontal, respectively, as viewed in the drawings, to ensure impact over a relatively small area without requiring extremely high manufacturing precision of the inertial igniter parts. It is, however, appreciated by those skilled in the art that the flat ridge surface 311 and 312 of the impacting ridges 271 and 272, respectively, do not have to be vertically and horizontally directed to achieve the goal of small impact surfaces even when the inertial igniter parts are not very high in geometrical precision. The only requirement to achieve the goal is that the two surface strips 311 and 312 are not parallel and make a considerable angle (such as 90 degrees) with each other.

While the one-part pyrotechnic material 273 is shown the body 251, it can alternatively be provided on the striker mass 258. Alternatively, a two-part pyrotechnic can be used in which one part is provided on each of the body 251 and striker mass 258.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertial igniter comprising:

a body having a base;

a striker release element rotatably disposed on the body, the striker release element having a first surface;

a first biasing element for biasing the striker release element away from the base;

a striker mass rotatably disposed on the base along a second axis, the striker mass having a second surface corresponding to the first surface of the striker release element, the first surface obstructing rotation of the striker mass; and a second biasing element for biasing the striker mass such that the second surface is biased towards the first surface;

wherein when the body experiences an acceleration profile of a predetermined magnitude and duration, the striker release element rotates towards the base to release an engagement between the first and second surfaces and allow the striker mass to rotate under a biasing force of the second biasing element.

2. The inertial igniter of claim 1, wherein the striker mass includes a striker surface and the body includes a striken surface, the inertial igniter further comprising a pyrotechnic material disposed on at least one of the striker surface and striken surface, such that release of the engagement between the first and second surfaces further allows the striker surface to strike the striken surface to activate the pyrotechnic material.

3. The inertial igniter of claim 2, wherein the striker surface and striken surface comprise rectangular surfaces in which a length of the striker surface is non-parallel to a length of the striken surface.

4. The inertial igniter of claim 3, wherein the length of the striker surface is orthogonal to the length of the striken surface.

5. The inertial igniter of claim 2, wherein the base further includes a hole proximate to the striken surface for passage of sparks resulting from the activated pyrotechnic material.

6. The inertial igniter of claim 1, wherein the first surface is on a recess formed in the striker release element and the second surface is on a projection formed on the striker mass.

7. The inertial igniter of claim 6, wherein the striker release element includes an additional recess for allowing the projection to pass when the striker mass rotates under a biasing force of the second biasing element.

8. The inertial igniter of claim 1, wherein the first biasing element is selected from a torsion spring, compression spring and leaf spring.

9. The inertial igniter of claim 1, wherein the second biasing element is a torsion spring.

10. The inertial igniter of claim 9, wherein the torsion spring is connected at one end to the body and at another end to the striker mass.

11. The inertial igniter of claim 10, wherein the base having a post upon which the striker mass rotates, the post having a slot for accommodating the one end of the torsion spring.

12. The inertial igniter of claim 1, wherein the striker release element is rotatable about a first axis and the striker mass is rotatable about a second axis orthogonal to the first axis.

13. The inertial igniter of claim 1, further comprising a rolling element disposed between the first and second surfaces.

14. The inertial igniter of claim 13, wherein the rolling element is one of a ball and cylinder.

15. The inertial igniter of claim 13, wherein at least one of the first and second surfaces includes a dimple for retaining the ball element.

16. The inertial igniter of claim 1, wherein the body further includes a stop for limiting a rotation of the striker release element away from the base.

17. The inertial igniter of claim 16, wherein the stop comprises a top plate.

18. The inertial igniter of claim 1, wherein at least one of the first and second surfaces include a reduced friction material disposed thereon.

19. A thermal battery assembly comprising:

a thermal battery; and an inertial igniter comprising:

a body having a base;

a striker release element rotatably disposed on the body, the striker release element having a first surface;

a first biasing element for biasing the striker release element away from the base;

a striker mass rotatably disposed on the base along a second axis, the striker mass having a second surface corresponding to the first surface of the striker release element, the first surface obstructing rotation of the striker mass; and a second biasing element for biasing the striker mass such that the second surface is biased towards the first surface;

wherein when the body experiences an acceleration profile of a predetermined magnitude and duration, the striker release element rotates towards the base to release an engagement between the first and second surfaces and allow the striker mass to rotate under a biasing force of the second biasing element;

the striker mass includes a striker surface and the body includes a striken surface, the inertial igniter further comprising a pyrotechnic material disposed on at least one of the striker surface and striken surface, such that release of the engagement between the first and second surfaces further allows the striker surface to strike the striken surface to activate the pyrotechnic material; and a hole for passage of sparks resulting from the activated pyrotechnic material into the thermal battery.

* * * * *